US009102429B2

(12) United States Patent
Corradi et al.

(10) Patent No.: US 9,102,429 B2
(45) Date of Patent: Aug. 11, 2015

(54) APPARATUS FOR DISPENSING AND INSERTING PACKAGING MATERIAL IN CONTAINERS AND METHOD THEREFORE

(75) Inventors: Marco Corradi, Reggio Emilia (IT); Paolo Corradi, Reggio Emilia (IT)

(73) Assignee: Storopack Hans Reichenecker GmbH, Metzingen (DE)

( * ) Notice: Subject to any disclaimer, the term of this patent is extended or adjusted under 35 U.S.C. 154(b) by 433 days.

(21) Appl. No.: 13/170,741

(22) Filed: Jun. 28, 2011

(65) Prior Publication Data

US 2011/0308204 A1 Dec. 22, 2011

Related U.S. Application Data

(63) Continuation of application No. PCT/EP2009/009318, filed on Dec. 30, 2009.

(30) Foreign Application Priority Data

Dec. 31, 2008 (IT) ..... RE2008A0122

(51) Int. Cl.

| | |
|---|---|
| ***B65B 3/04*** | (2006.01) |
| ***B65B 55/20*** | (2006.01) |
| ***B65B 57/14*** | (2006.01) |
| *B65B 5/10* | (2006.01) |

(52) U.S. Cl.

CPC ..... *B65B 55/20* (2013.01); *B65B 57/14* (2013.01); *B65B 5/10* (2013.01)

(58) Field of Classification Search

USPC ..... 53/474, 473, 475, 503, 504, 52

See application file for complete search history.

(56) References Cited

U.S. PATENT DOCUMENTS

| | | | | |
|---|---|---|---|---|
| 4,922,687 | A * | 5/1990 | Chow et al. | 53/472 |
| 5,109,347 | A * | 4/1992 | Quick et al. | 700/240 |
| 5,623,815 | A * | 4/1997 | Hornstein et al. | 53/472 |
| 5,719,678 | A * | 2/1998 | Reynolds et al. | 356/627 |
| 5,850,370 | A | 12/1998 | Stringer et al. | |

(Continued)

FOREIGN PATENT DOCUMENTS

WO WO2006017602 2/2006

OTHER PUBLICATIONS

First Office Action, Chinese National Phase of PCT/EP2009/009318, Nov. 1, 2012.

(Continued)

*Primary Examiner* — Sameh Tawfik

(74) *Attorney, Agent, or Firm* — Wood, Herron & Evans, LLP

(57) ABSTRACT

An apparatus, and the methods therefore, that automatically detects, elaborates and interprets the geometry of a container (2) and of one or more of the contained articles (3), and supplies and inserts, automatically, packaging material into the container in a suitable manner and amount. The apparatus comprises one or more sensors (6) for measuring the geometric profile of the container (2) and of the contained articles (3). The apparatus comprises in addition processing means (14) that acquire the measurement data of the geometric profile and elaborates packaging instructions. The apparatus comprises also devices for the dispensing (42) and insertion (43) of packaging material into the container (2). The apparatus can be equipped with a conveying device (4) for transporting the containers to the measuring sensor (6) and to the dispensing device (42) and insertion means (43) of the packaging material.

14 Claims, 9 Drawing Sheets

(56) References Cited

U.S. PATENT DOCUMENTS

| | | | | |
|---|---|---|---|---|
| 6,603,563 | B1 * | 8/2003 | Gagliano | 356/601 |
| 6,771,804 | B1 * | 8/2004 | Maetschke | 382/141 |
| 7,277,187 | B2 | 10/2007 | Smith et al. | |
| 7,337,595 | B2 | 3/2008 | Harding | |
| 7,814,733 | B2 | 10/2010 | Carlson et al. | |
| 2001/0017023 | A1 | 8/2001 | Armington et al. | |
| 2009/0277139 | A1 | 11/2009 | Eckel | |

OTHER PUBLICATIONS

PCT/EP2009/009318 International Search Report.

PCT/EP2009/009318 Written Opinion of the International Searching Authority.

* cited by examiner

APPARATUS FOR DISPENSING AND INSERTING PACKAGING MATERIAL IN CONTAINERS AND METHOD THEREFORE

RELATED APPLICATIONS

This application is a continuation application and/or a 35 USC 371 national stage application of International Patent Application No. PCT/EP2009/009318 filed Dec. 30, 2009, which claims priority to IT Patent Application No. RE2008A000122 filed Dec. 31, 2008, both of which are hereby incorporated by reference herein as if fully set forth in their entirety.

FIELD OF THE INVENTION

This invention relates generally to the end-of-line packaging and more precisely to an apparatus for dispensing and inserting packaging material in containers containing articles.

BACKGROUND OF THE INVENTION

Packaging processes characterized in high productivity and standardization of the articles to be packaged have reached an high automation level, but in those cases where the variability of the articles is a predominant peculiarity of the process, the presence of the man still is necessary.

That is what happens, for instance, in packing-shipping processes by which one or more articles are put inside suitable containers and sent over to the packaging station, where an operator is in charge of manually inserting filling or protective packaging material into the containers, being said material usually crumpled paper, expanded loose-fill chips, air bags or pads, air bubbles film, polyurethane foam expanded in place or others.

In these processes the filling materials have merely the function of filling the void volume left inside the container and of avoiding the articles from moving within that, therefore these applications are known as "void filling" packaging processes.

Air bags, air pads and crumpled paper packaging technologies rely on the manual inserting of said materials, dispensed by special machines, into the containers. The operator evaluates the needed amount of materials directly during the inserting action; if too much material has been dispensed, then the operator simply takes it out of the container and keeps it available for the next one. If the operator puts the material not properly into the container, then the operator can simply take it out and use it again for next packages.

Loose fill chips are usually, but not necessary, stored in big bags approximately 1 cubic meter volume capacity hanging on a support frame above the packaging station. The operator takes care of discharging the loose fill chips down into the container by means of a manual actuated valve, of driving the stream of chips towards void areas and of dosing the proper amount of material. If an over-dosing or wrong dispensing should occur, the consequence is just some chips on the floor to be cleaned up. If an underestimated dosing should occur, the operator simply needs to dispense some more chips.

Packaging technology by means of polyurethane foam expanded in place, known as "foam-in-place" or "foam-in-bag", provides undiscussed benefits, however it is much more sensitive than the previously mentioned technologies. Foam-in-place is to be understood as a generic term that includes all systems capable to produce PU foam in situ, therefore both automatic or semi-automatic bag machines and hand held machines. Foam-in-place bags technology consists in inserting plastic bags into the container, being inside the bags a chemical substance or mixture that expands and fills therefore the void volume available in the container, this way blocking the articles contained. This technology requires a foam precursors mixing machine with a bags forming device.

The operator estimates the volume and the shape of the void space within the container where the articles to be packaged are, then the operator sets the foam-in-place system for the dispensing of the most appropriate bag or bags.

Commonly set parameters are the lengths of the bags, being the width depending on the film roll installed on the equipment, and the bag filling percentage, that is relative to the maximum bag volume allowed by the set length of the bag. This estimating and setting methodology is the one mainly adopted by the foam-in-place systems manufacturers, providing the operator an easy process managing methodology: the intuitive comparison between the void volume within the container and the volume of the expanded foam. However, this approach is very approximate, and experienced and skilled operators only are able to obtain acceptable, but never optimal, performance.

An undersized bag, due to wrong length or filling percentage, leads to a not effective package or to a waste of material, the expanded bag being difficultly re-employable. A light over-sizing leads to a waste of material; an over sizing may likely lead to a bag breaking and therefore the foam spreads over the articles; the oversized bag may prevent flaps from being closed as well. In both situations it is necessary to replace the bag and the obvious consequence is a waste of foam and a lost of productivity.

The bags estimation is even more complicated due to "shape factors": the foam expands within the container driven both by the void space geometry and by the film layers of the bag in which it is contained. Because of that, it is not enough the operator estimates the void volume value to be filled, but he has to consider its shape also in order to set the most suitable bag.

Besides void filling applications, the target of other packaging processes is articles protection.

Crumpled paper, air bags or air pads packaging technologies allow packaging by tentative: material can be added, taken out or moved from an area to a different one without any problem.

Although foam-in-place is the most effective protective-packaging technology, it is also the most sensitive from the application stand point because a recovery chance is not given: if the bag is not the proper one for the addressed location or if it has been inserted wrongly, since the foam expansion starts there will not be chances to modify the situation: it will be necessary to replace that bag with a new one.

An oversized bag may shift, while expanding, the articles from the original position towards the container side, alternatively it may deform the container side; wrong sized or badly inserted bags may break the film (foam flows out). On the other hand, undersized bags will compromise the protection performance.

Furthermore, the foam expands in radial direction tending to assume a spherical shape; that characteristic does not help at all reaching distant corners or expanding through narrow corridors. Some void space geometry can be filled only by using several bags put in critical positions. Process unknown parameters are therefore the types and the number of bags to be dispensed, and the proper disposition inside the container, with the target of both protecting the articles at the maximum extent and optimizing the amount of dispensed foam.

With regards to that, it is known, through publication WO2007121169, a packaging system which relies on the void volume measurement within a container containing articles.

The void volume measured value is transmitted to a machine that dispenses, accordingly to that void volume value, a proper amount of packaging material, crumpled paper in a preferred embodiment of the invention. Then the operator manually receives the paper and inserts it into the container, without being driven or instructed about the most effective disposition.

As previously explained, and mostly with reference to the foam-in-place systems, the value of the void volume to be filled is not enough to realize a good package; it is indeed necessary to determine and interpret the geometrical location of the articles inside the container or, which is the same, the geometrical distribution of the void volume in order to make the right decision about the most suitable dispensing and inserting of packaging material. Again with reference to the foam-in-place technology, several bags are often necessary, accurately inserted and filled with the necessary amount of foam, which is calculated to fill a specific fraction of the total void volume only. By knowing this information, the difficult decisional step the operator has to make, particularly critical in foam-in-place systems, is not any more necessary; then the process automation becomes possible by using automatic devices able to dispense and insert the packaging material, these devices being driven by the instructions generated automatically through the processing of the geometrical distribution data acquired.

Hence the object of this invention is to provide a packaging apparatus and method that are more economical and more reliable than those known in the state of the art.

SUMMARY OF THE INVENTION

These aims are achieved with the apparatus and the method according to the independent claims. Additional important features are listed in dependent claims.

The inventive apparatus and method are able to replace the operator's will in calculating the necessary volume of packaging material, in interpreting its shape, in making the decision about dispensing and inserting the material and in performing these action as well, by acting directly and automatically on the articles to be packaged.

Furthermore, the inventive apparatus and method allows to interpret the shape of the void space left in a container in which one or more articles have been placed and allows to calculate not only the necessary volume of packaging material, but also, through the processing of these data and determining the geometrical distribution of the void space, to determine the most suitable dispensing and inserting modality and the relative actions as well.

In particular, according to one aspect of the invention, the apparatus comprises a detection unit and processing means that detect and elaborate the geometrical shape of the containers and of the articles.

The detection unit may comprise one or more sensors hung, for instance, on a support frame right above a conveying line for the containers and contained articles. These sensors are able to measure quantities useful for calculating the geometric characteristics of said containers and articles.

According to another aspect of the invention, processing means comprise a logic device able to acquire data obtained from said sensors and able to process said data for generating instructions and commands about the dispensing and insertion modality of the packaging material. This logic device may manage and coordinate as well other devices involved in the process.

According to another aspect of the invention, the apparatus comprises a packaging material dispensing device; the dispensing is driven by the instructions and commands sent by the logic device, the dispensing device and the logic device being able to communicate. The dispensing device may be a foam-in-place bags system or a dispensing machine for other packaging materials, like loose fill products.

According to a further aspect of the invention, the apparatus comprises insertion means for inserting the packaging material into the containers; insertion means are driven by the instructions and commands sent by the logic device, being the insertion means and the logic device able to communicate. Said insertion means comprise an inserting device, which can be a single or multiple linear or rotational axes manipulator, or simply a sort of hopper or a motorized belt that convey the material into the containers, and/or comprise a graphic interface to instruct the operator about how and/or where to insert the packaging material into the container.

The apparatus according to this invention is particularly effective in solving peculiar issues of foam-in-place applications, but can be successfully employed also in other packaging technologies.

According to a further aspect of the invention, an automatic packaging method for articles in containers is disclosed; this method is performed through the apparatus explained above. A packing method in human-assisted mode is also disclosed: with this method, an operator looks at the instructions output by the logic device on a graphic interface and inserts manually the material into the container following said instructions; according to one aspect of the invention, the apparatus is still in charge of determining dispensing the material and the insertion instructions.

The invention provides the advantage of automatically providing not only the correct amount or volume, respectively, of packaging material, but also of providing the packaging material at such a location that the void space is best filled and the articles are best protected. As a result, damages to the articles due to shipping are less often. To achieve these objects, no additional person is needed. Instead, manpower can be reduced, such that the cost for placing the packaging material is reduced.

BRIEF DESCRIPTION OF THE DRAWINGS

The features and the advantages of the apparatus for dispensing and inserting packaging material in containers and method therefor, will be evident from the following description, regarding particular embodiments thereof, which is made as a non limiting example with reference to the attached drawings, wherein.

DETAILED DESCRIPTION OF THE INVENTION

Figure 1:
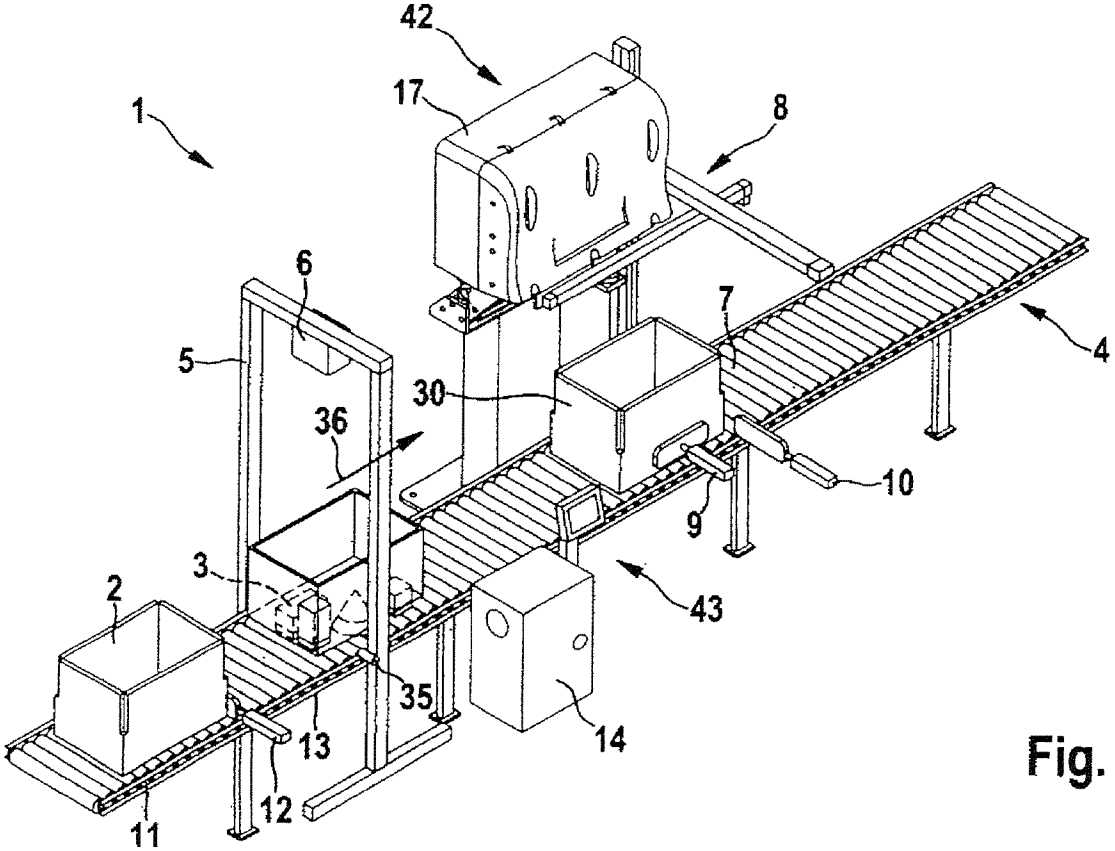
FIG. 1 is a schematic perspective view of a first embodiment of an apparatus according to the present invention, which employs, as packaging material dispensing device, a foam-in-place system dispensing bags.

FIG. 1 shows an embodiment of an apparatus 1 for dispensing and inserting packaging material: containers 2 containing the articles to be packaged 3 are conveyed, by a motorized conveying device 4, through a gate frame 5 holding one or more sensors 6 capable of providing data useful to the calculation of geometric characteristics of containers 2 and contained articles 3.

The motorized conveying device 4 transports the containers through the gate frame 5, one after the other and keeping each apart from the contiguous ones, and to a packaging area 7. A suitable conveying device could be, for instance, a motorized rolls conveyor 4 split in two zones, a first one 11 ("slow zone") conveying at a lower speed than the second one 13 ("fast zone"), the second one 13 extending from and through the gate frame 5 area and extending further to the packaging area 7.

A stopping device 12, placed along the conveying device 4 and in between the slow zone 11 and the fast zone 13, stops the containers 2 if it is actuated as shown in the figure. When the stopping device 12 is retracted and thus disengages from the container 2, one container 2 moves on to the fast zone 13, accelerating and separating from the next one.

The distance that now is between the container 2 and the following one allows the stopping device 12 to move back up to the stop position.

When the container 2 reaches the packaging area 7, a stopping device 10 crosses the conveyor device 4 and thus stops said container 2 when it is actuated as shown in the figure. Thus, the container 2 is aligned to a first reference co-ordinate. Then an actuated pushing device 9 aligns said container to the second reference co-ordinate. The container 2 is now in a defined "packaging position". Once the packaging material has been inserted into the container 2, devices 9, 10 and 12 retract and disengage from container 2 allowing therefore the container 2 in the packaging area 7 to leave the apparatus 1 and permitting the next container 2 to come in.

Figure 2:
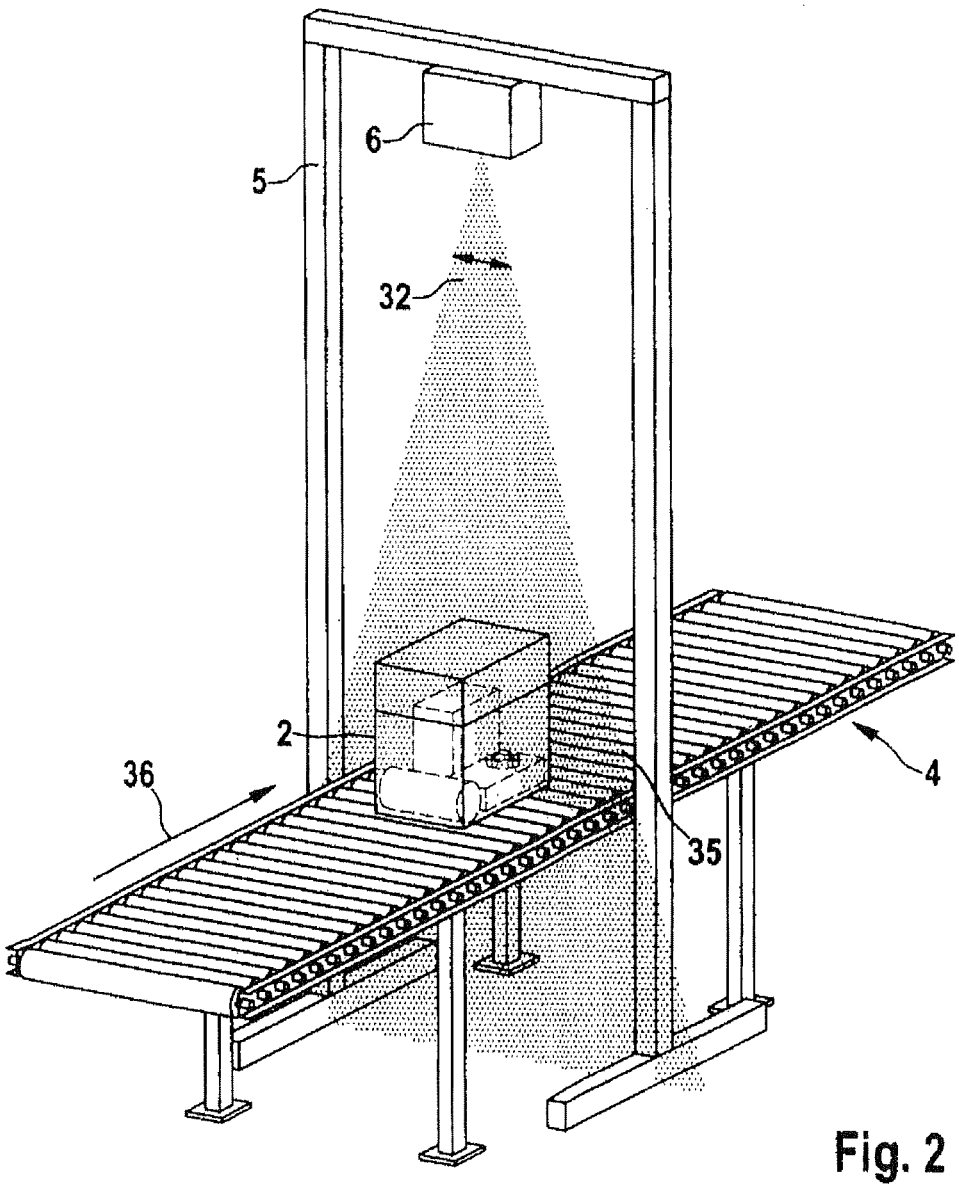
FIG. 2 shows a perspective view of the support frame of the apparatus of FIG. 1 with a measurement sensor for the geometrical characteristics of the container and articles contained (contents from now forward)

The working principle of the sensors 6 or, in more general terms, of detection unit 6 can be based on different technologies, for example optical technologies (e.g. LASER scanning, Indirect Time-of-Flight, structured light, LASER triangulation, one or more cameras or others) or ultrasound technologies. With reference to FIG. 2, according to a preferred embodiment of the invention, said detection unit 6 is a LASER scanning device, which calculates the distance between its emitter and the incidence point of the LASER beam on the object surface by means of a mechatronic system that is able to measure the "phase-shift" of the modulated LASER signal reflected by the object. Said LASER scanning device provides sensing in a two-dimensional measurement plane 32, which is defined by a scanning aperture angle and by the distance between the LASER scanning device and the motorized conveying device 4, normally oriented along a plane that is orthogonal to the direction 36 of the motion of the container 2 and the articles 3 (referring to FIG. 3*a*).

Figure 4:
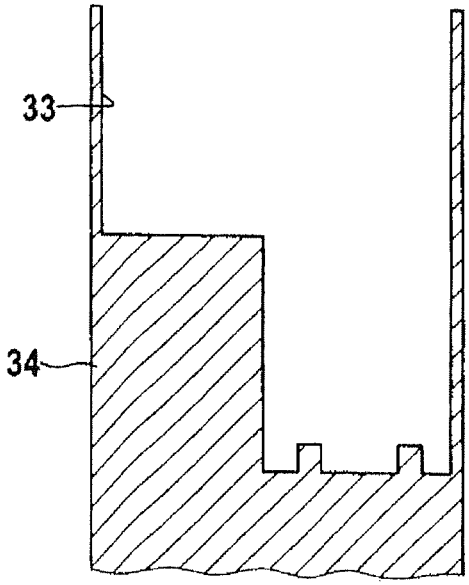
FIG. 4 shows a cross section of the geometric profile of the container and its contents of FIG. 2.

Said LASER scanning device is capable to define, point-by-point, and with a finite resolution depending on settable parameters, the geometric profile 33 of the underneath container 2 and of the contained articles 3 (as FIG. 4 illustrates in a theoretical example), by detecting the relative distances to said LASER scanning device. By the term "geometric profile" is meant, with reference to FIG. 4, the line that identifies the upper border of the single cross section 34 of the container 2 and the contained articles 3, which is obtained by connecting the points located by the LASER scan. The LASER scanning device that may be used in the apparatus 1 is the model LMS-400-1000 from Sick AG. The measurements or measurement signals, respectively, provided by the detection unit 6 are acquired by a logic device 14, which, according to a preferred embodiment of the invention, is a computer equipped with specific processing and control software and with a display. Following to its function, it may be called "elaborating" or "processing" means.

The forward motion of the motorized conveying device 4 allows scanning several cross-sections or, more precisely, transversal geometric profiles 33, according to the previous definition, making the logic device 14 able to generate, in real time, a three-dimensional model of the scanned surface of the whole container 2 and the articles 3 contained therein, and consequently a digital and meshed reproduction of the solid geometry of the articles 3 and container 2, on the basis of the known instantaneous speed of the motorized conveying device 4, said speed obtained by means of a suitable sensor or being fixed as a constant.

The frame 5 can then be equipped with one or more further sensors, for example, photocells 35, in order to detect the passage of the containers 2 and to start the measurement, being also helpful in the measurement of the geometrical parameters of the containers, e.g. the length.

It should be noted that the processing means are capable to provide correct results regardless how the containers are oriented during the scan: thus there is no need for alignment devices along the conveying device 4, because said processing means can anyhow calculate the geometrical characteristics of the container 2 and of the contained articles 3 in several ways, for example by exploiting analytic geometry algorithms and in general algorithms in the field of the "machine vision", supported by the knowledge that the container has the solid geometry of a parallelepiped. According to a preferred embodiment of the invention, the apparatus 1 is conceived to work with containers having a known proportion between the width of the container 2 and the height of the flaps 16, although this characteristic is not a limit of the invention.

Figure 5:
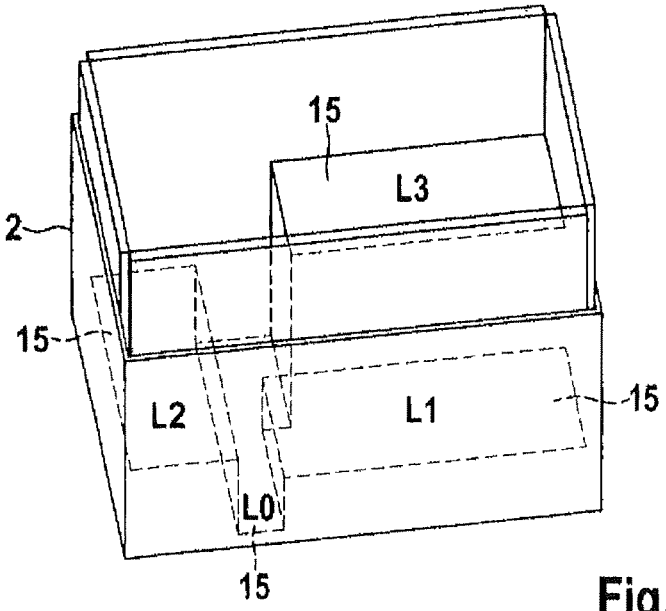
FIG. 5 shows a perspective view of the container of FIG. 2, wherein sets of geometrical points are identified, said sets of geometric points determining spatial distributions of contents with comparable heights.

With reference to FIG. 5, a major aspect of the invention is pointed out, which consists in an automatic process of interpretation of the specific distribution of the solid geometry of the articles 3 contained in the container 2 (prior to which other processing steps of the acquired data may be performed), and thus, of a corresponding geometric interpretation of the space in the container that is not occupied by the articles ("void space" in the following), with the aim to define the proper modalities for dispensing and automatically inserting the packaging material, in particular to define the amount, size and shape of the filling material that is to be placed within the container, and also to define the location where the so defined filling material is to be placed. With this regard, as an example and without limiting the invention, methods of data processing can be used, which allow to subdivide the set of geometric points (or the corresponding polygonal "mesh" structure that is possible to generate with them) composing the profile of the contained articles 3, in sub-sets of geometric points (or in sub-sets of polygons composing the polygonal mesh) having one or more characteristics in common or analogous.

Regarding this approach, in the technical field it is referred, as a non-limiting example, to "segmentation" processes. One of said characteristics to be considered in this interpretation process, and that is useful for the application, consists in the value of the distance that each geometric point composing the three-dimensional geometric profile of the contained articles 3 (or each polygon composing the corresponding polygonal mesh) has from a reference plane. In order to clarify the concept, a simple example, which is not limiting for the invention, is proposed in the following by considering the case of a three-dimensional geometric profile that is obtained by LASER scanning of the contained articles 3 in FIG. 3*a*. Said profile consists of a so called "height field", that is a set of geometric points with different distances, or heights, calculated relatively to a reference plane, e.g. the plane of the motorized conveying device 4.

In order to optimize the data processing, said set can be suitably converted, for example, in an equivalent image in colour-scale, which values represent, according to a proper conversion, the heights of the geometric points detected by the scan. Many processing and interpretation steps can be performed on said two-dimensional representation, said steps generally belonging to the techniques and methods of the "computer vision", with the aim to extract characteristics and information useful to the process of interpretation of the geometrical distribution of the articles in the container and, therefore, of the void space.

Figure 3A:
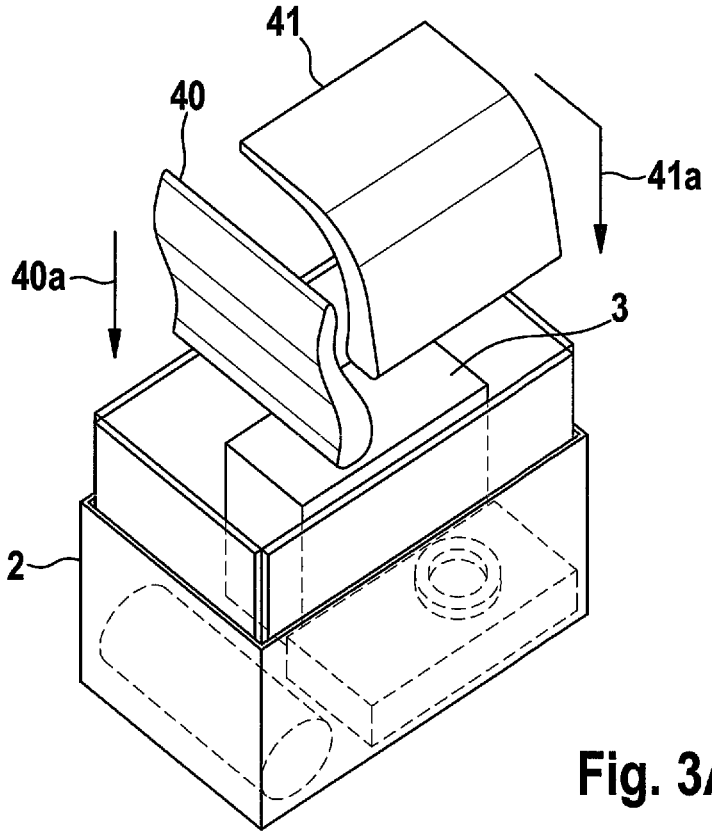
FIGS. 3A and 3B show more in detail and more distinctly a perspective view of the container of FIG. 2 and the contents visible by transparency.

FIG. 5 illustrates a perspective view of the contained articles 3 (and the container 2) of FIG. 3*a*, subdivided in four sets according to a generic rule that imposes that all the geometric points, composing the profile of the contained articles 3, which have a height value belonging to suitable ranges, or within suitable thresholds, are clustered in a set 15 (that in this case can be defined as a "layer" with reference to FIG. 5) with a specific height value (L0, L1, L2, L3). This process involves all the geometric points of the profile (three-dimensional model of the scanned surface) of the contained articles 3. The morphology of said layers is defined according to rules that are specific to the used method (for example, by means of image processing techniques exploiting binary particle classification) and depending on a dispensing device 42 and an insertion means 43 and packaging material used. It could be, in the simplest solution, rectangular. From a three-dimensional viewpoint, each of said layers locates a region of space underneath, for which the layer is a geometric projection on any of the planes parallel to the bottom of the container 2. Said region of space locally defines the simplified solid geometry of the contained articles 3 (with the inclusion of the bottom of the container). In the same way, each of said layers locates a region of space on top of it (which extends as far as the plane that identifies the upper border of the container with the closed flaps), which locally defines the simplified solid geometry of the region of void space to fill in. As a conclusion, in the example of FIG. 5, the whole void space in the container is subdivided in four different regions of space, each of them with a simplified fully known solid geometry.

Different and suitable methods and algorithms to elaborate/process and interpret the geometry of a solid are known in the state of the art and can be used in an analogous manner in order to interpret and simplify the solid geometry of the contained articles, and thus the solid geometry of the void space to be filled with packaging material, without departing from the scope and the spirit of the general inventive concept.

Following the data processing and interpretation process, the logic device 14 has several information regarding said regions of void space, that are: the position (relative to the container 2), the simplified geometric dimensions and shape, and the corresponding volume. The latter has been calculated on the basis of the local geometry identified by the contained articles 3 (i.e. the volume of the region of void space is calculated on its actual geometry (no simplification), while the instruction about dispensing and inserting is based on a simplified geometry; this is done in order to obtain a precise information of the quantity, i.e. of the volume, of the necessary packaging material). The logic device 14 can therefore communicate to the dispensing device and insertion means the respective commands and instructions in order to perform the packaging. As an example, said instructions may comprise informing the dispensing device 42 about the corresponding volume value for each of said regions of void space, and, depending on the packaging material, about one or more dimensions characterizing said regions of void space (e.g. depth and/or length and/or width). The instructions sent to the insertion means 43 will consist of a set of coordinates and insertion steps that are based on the computed data about the position of said regions of void space in the container.

The output signals of the logic device 14 can vary according to the working modalities and the typology of the used dispensing device 42 and insertion means 43. In case that the dispensing device 42 dispensing the packaging material comprises a foam-in-place bag dispenser 17, which is the preferred embodiment, the logic device 14 communicates to the dispensing device 42, on the basis of the results obtained by the elaboration process above described, the following: how many bags to produce (depending on the number of located regions of void space), which length the bags shall have (in most cases, this value has to be proportional, for instance, to the depth and to the volume of the corresponding region of void space), and which volume the bags shall expand to. The logic device 14 communicates then to the insertion means 43 where and how to insert the fabricated bags into the container 2 (depending on the position of the regions of void space in the container).

The processing and interpretation process of the measured data includes the possibility to perform operations of "association" or "union" of said located regions of void space not occupied by the articles 3, according to fixed rules and in the modalities allowed by the dispensing device 42 and the insertion means 43, and possibly suggested by a database offering several different possible combinations limited to a simplified classification. For example, with reference to FIG. 3*a* and FIG. 5, a bag 40 will be inserted vertically, as indicated by arrow 40*a*, until it reaches its final position as shown in FIG. 3*b*; in this case the logic device 14 has chosen for a "union" of the two regions of void space, corresponding to L0 and L2, into a single region, which therefore is filled by the single bag 40.

Figure 3B:
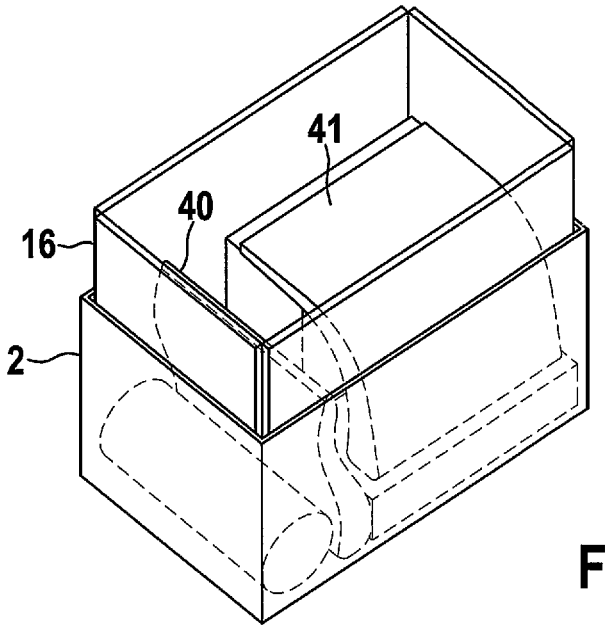

The insertion modality for the bag 41 is indicated by the arrow 41*a*, while the final position of the bag is illustrated in FIG. 3*b*; in this case the logic device 14 has chosen for an "association" of L1 with L3, imposing to the bag 41, during the positioning, a specific shape of an upside-down "L". In this way, once the flaps 16 of the container 2 have been closed, the foam, while expanding inside the bags 40 and 41, does not find any resistance to form a rectangular pillow in the case of the bag 40, and an upside-down "L"-shaped pillow in the case of the bag 41.

The spatial adaptability of the foam during its expansion inside the defined regions of void space, on which corresponding real volume value (as previously defined) the quantity of packaging material has been dispensed, has the effect to compensate for the geometric simplification that may optionally have been performed in the interpretation process of the geometry of the contained articles 3, previously described as an example.

Figure 6:
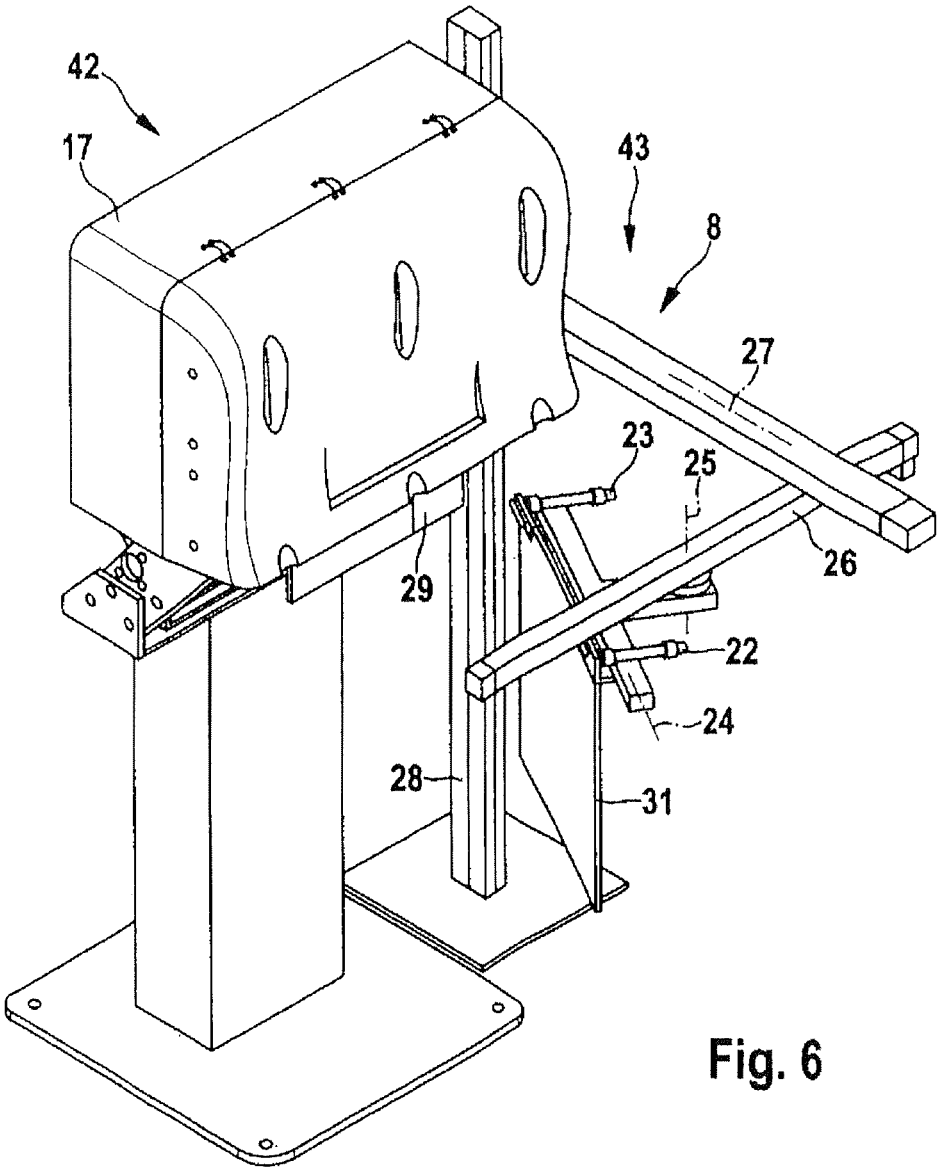
FIG. 6 is a schematic perspective view of a possible embodiment of the insertion device linked together with a foam-in-place bag dispensing machine.
Figure 7A:
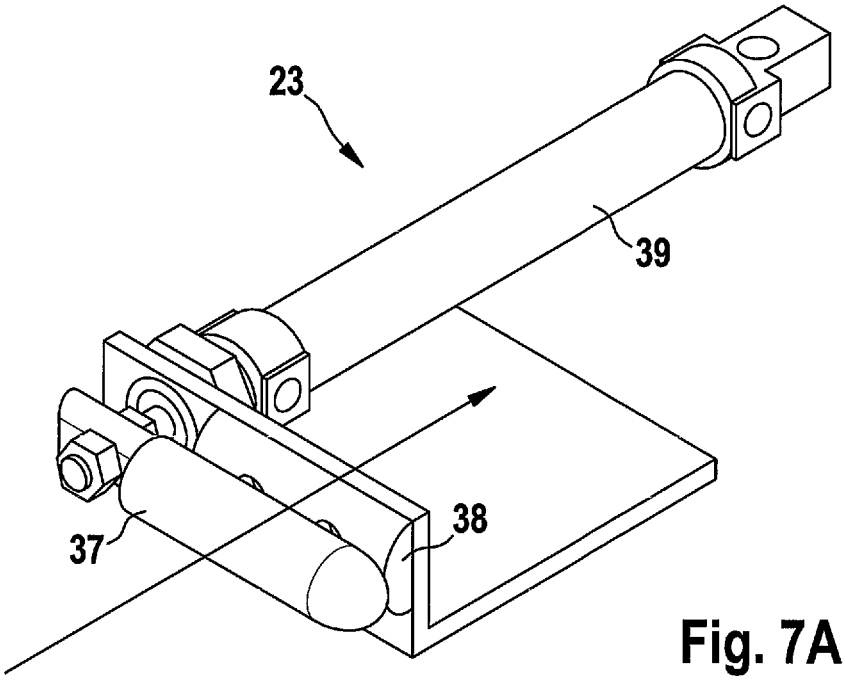
FIGS. 7A and 7B are schematic perspective views of a possible embodiment of a grabbing tools of the insertion device.
Figure 7B:
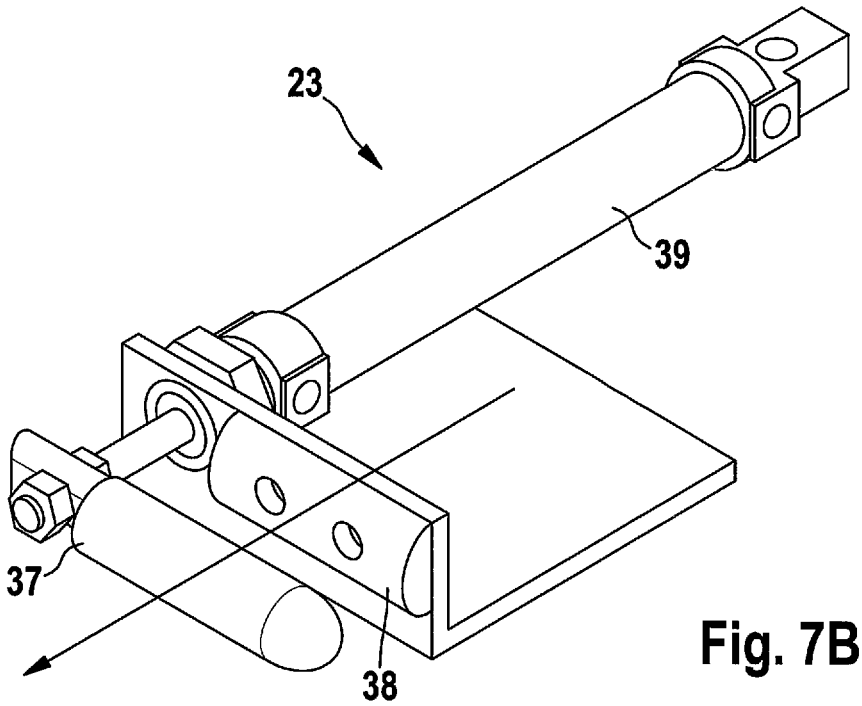

A preferred device 43 for inserting the foam bags comprises a manipulator 8 with two grabbing tools 22 and 23 for a bag 31 and four axes 24, 26, 27 and 28 of linear motion and one axis 25 of rotational motion, as illustrated in FIG. 6, where the manipulator 8 is applied to a typical foam-in-place bag machine 17 and for a possible configuration of bag insertion. A foam-in-place bag machine 17 typically dispenses, from up to down and through a suitable opening, a bag 31 fabricated with plastic film, with variable length and fixed width, containing a mixture of liquids. Each grabbing tool 23, 24 consists of a jaw having a fixed portion 38 and a movable portion 37 which is actuated, for example, by a pneumatic cylinder 39, which reciprocates as illustrated in FIGS. 7*a* and 7*b*, respectively, with reference to the right grabbing tool 23, the left grabbing tool 22 being characterized by a symmetrical design.

When the foam-in-place machine 17 stops the feeding of the film in order to seal and cut the upper edge of bag 31, the grabbing tools 22 and 23, which are positioned along a film feeding plane 29 with open jaws as long as the film is "flowing" through them, grab the upper edge of the produced bag 31 by closing the jaws. The bag 31 is now held by grabbing tools 22 and 23 positioned on the horizontal linear axis 24 that, according to the kinematical chain represented by the manipulator of FIG. 6, can rotate around the vertical rotational axis 25, said axis 25 being capable to move along the horizontal linear axis 26, the linear axis 26 being capable to move along the horizontal linear axis 27, the linear axis 27 being capable to move along the vertical linear axis 28. In a preferred embodiment, the axis 26 is parallel to the motion direction 36 of the motorized conveyor device 4 (see FIGS. 1 and 2); the axis 27 is perpendicular to the motion direction of the motorized conveyor device 4.

It is to be understood that the bag 31 can be left to fall down or brought into the container 2 according to an infinite number of planes that are orthogonal to the plane of the motorized conveyor device 4, or, by combining several of the motion capabilities of the manipulator, the bag can be inserted into the container in further positions in addition to the vertical one, as, for example, is indicated by arrow 41*a* in FIG. 3*a*. In addition, the grabbing tools 22 and 23 can get closer to each other by moving symmetrically along the axis 24.

The grabbing tools 22 and 23 can grab the bag 31 in fabrication also from the lower edge by closing as soon as the fed length of the bag 31 allows the catching; this modality allows guiding the film fed by keeping the bag laying down horizontally, by means of a back motion of the axis 26, in order to favour the distribution of the liquid along the length of the bag 31 (which is an important characteristic during the dispensing step).

As soon as the insertion of the bags 31 into the container 2 is completed, it is necessary to bend the flaps 16 down and close the container 2 in order to create the geometry of the void space, which was computed by the logic device 14, and which the foam will fill while expanding. The container closure can be manual or automatic, by means, for example, of a taper machine placed downstream the described arrangement.

The insertion device 43 described above is conceived for complex packaging; for simpler applications (not shown), e.g. top void filling, it can be sufficient employing conveying means, for example a hopper, which can be oriented by means of a device with two axes of motion that is capable to route the bag, coming out from the dispensing device, into the region of the container selected by the logic device.

According to another important aspect of the present invention, the apparatus 1 allows also a working modality that is "human-assisted": if the apparatus does not comprise an automatic insertion device or if this device is out of service, the operator executes this operation manually by following the instructions displayed by an insertion means comprising a graphic interface. In addition, on this graphic interface it is possible to overlay a top-view image of the contained articles 3 on the three-dimensional geometry of the articles themselves, which means that an image of the articles (in terms of textures) can be super-imposed to the geometrical 3D model of the articles, thus providing support to the operator in understanding the geometry of the articles 3 contained in the container 2. In the preferred embodiment with the LASER scanning device, said image, which is visible in colour-scale, is obtained by acquiring the intensity of the LASER radiation being reflected by said articles.

Figure 8:
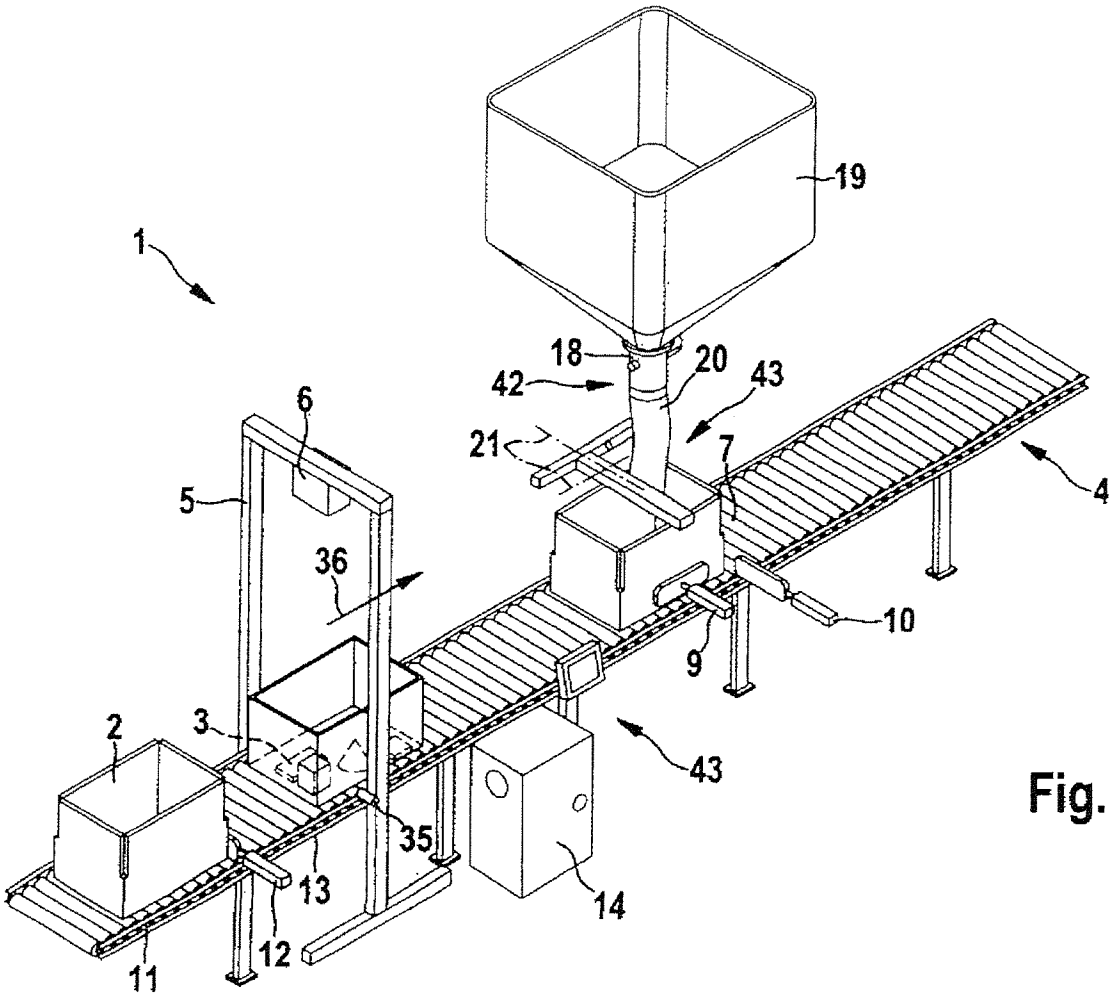
FIG. 8 is a schematic perspective view of a second embodiment of an apparatus according to the present invention, wherein the dispensing device dispenses expanded plastic material "chips" (loose fill)

In an alternative embodiment that is not using a foam-in-place machine, the apparatus can exploit small size packaging materials with fluid-like behaviour, for example expanded plastic "chips" (loose fill). With reference to FIG. 8, in this case the dispensing device 42 comprises a controllable flow valve 18 positioned at the bottom of a reservoir 19 which may comprise a large size bag in which generally the "chips" are stored, said reservoir 19 being arranged above the motorized conveying device 4. The insertion device 43 consists of a flexible hose 20 having a suitable diameter, with a proximal end connected to an outlet of controllable flow valve 18, and the other distal and open end suspended above the conveying device 4 and connected to a positioning device with two axes 21 of motion; the open end is moved by said positioning device to a position above the void regions of the container 2, so that the flow of "chips" dispensed by dispensing device 42 by operation of valve 18 is directed into the void regions.

Figure 9:
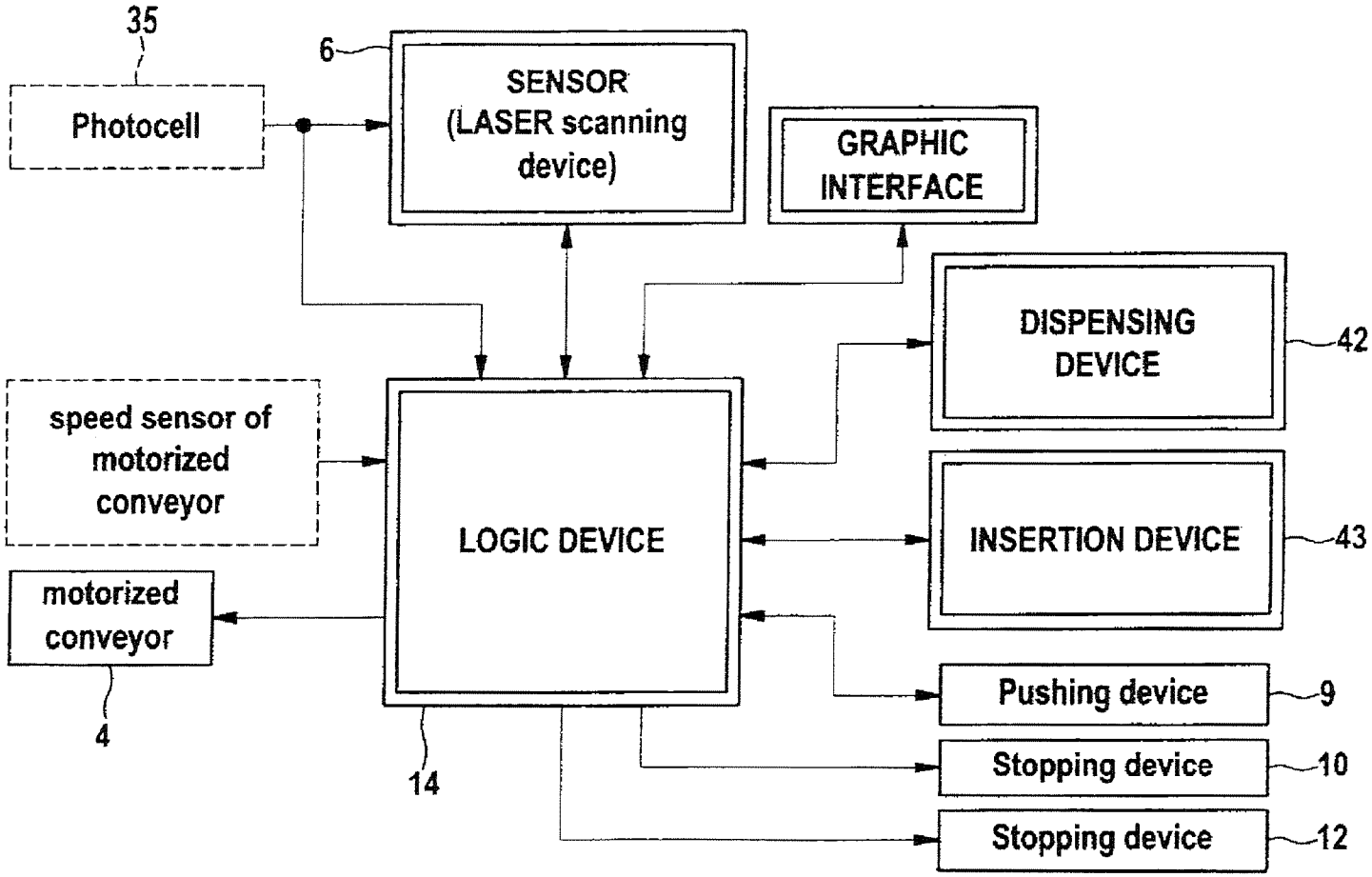
FIG. 9 shows a block diagram summarizing the apparatus in general and communication connections with a processing means in detail.

A functional block diagram of the physical parts of the apparatus 1 previously described is shown in FIG. 9. The figure shows the communication connections between different sensors and devices and the characteristic of directionality in communication.

Figure 10:
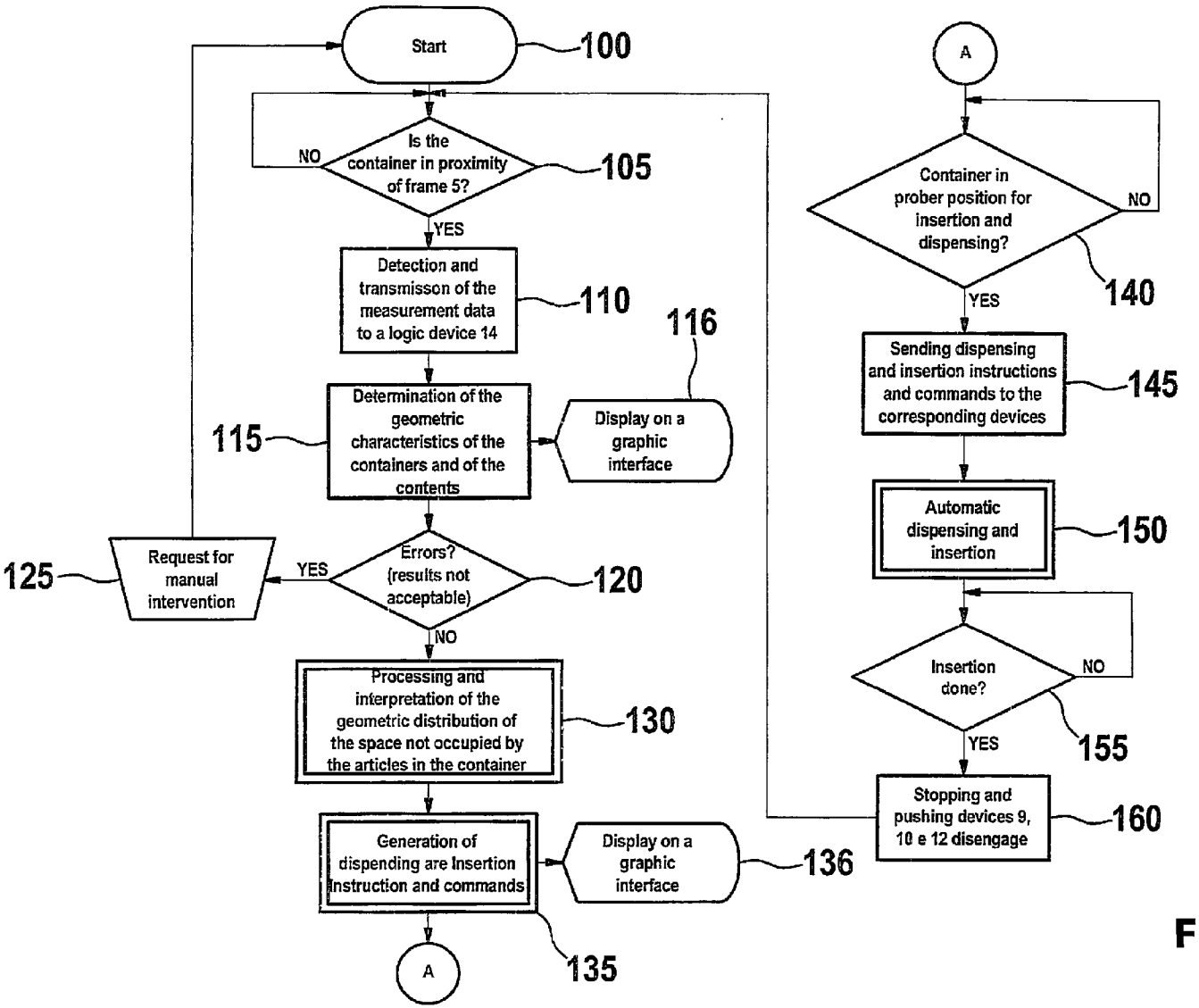
FIG. 10 shows a flow chart of the whole process.

In the following, a packaging method for dispensing and inserting material for packing articles in containers, based on the automatic packaging apparatus 1, is described as an example. In FIG. 10 a flow diagram is shown, which indicates the steps that are necessary to automatically execute the process of dispensing and inserting the packaging material. At step 100 the system is initialized and is ready to start. The automatic packaging cycle, which is a subject of the invention, begins at step 105, when the system enters in a stand-by state waiting for the passage of a container 2 through an area situated before or in correspondence of the frame 5, where a presence or proximity sensor, for example a photocell 35, informs the detection unit 6 and/or the logic device 14 of the occurred event. Next step 110 corresponds to the detection and transmission, in real time, of the measurement data measured by the detection unit 6 (e.g. a LASER scanning device) to the logic device 14, in which the geometric characteristics or equivalent parameters of the container 2 and the contained articles 3 are computed (step 115) and displayed on a graphic interface (step 116) for possible use in the following steps 120 and 125.

In these steps 120 and 125 the results of the processing of step 115 are evaluated. In case of invalid results or results outside the specifications are obtained (for example the articles 3 contained in the container 2 overflow the maximum level of filling of the container; one or more flaps obstruct the measurement; complete lack of articles 3 in the container, and/or other problems) the system stops and asks (step 125) for operator intervention. The operator checks the displayed results and can for example proceed to place back the container 2 upstream the frame 5, initializing again the automatic packaging process.

In case that the container 2 and the contained articles 3 have characteristics within the specifications, the logic device 14 proceeds to step 130, in which the geometric distribution of the void space in the container that is not occupied by the articles is elaborated/processed and interpreted. In step 135 it generates, in step 135, suitable commands and instructions to be sent to the dispensing device 42 and insertion means 43. In case of human-assisted working modality, the logic device 14 sends instruction and commands also to a display visible to the operator (step 136).

At this stage the system enters a stand-by state 140 waiting that the container 2 reaches the packaging area 7 and is properly arrested by the actuated stopping device 10 and positioned by the actuated pushing device 9, which will both send suitable signals to the logic device 14. In step 145 the commands and instructions generated at step 135 are sent to the dispensing devices 42 and insertion means 43 in the suitable modalities and with proper timing. In step 150 said dispensing devices 42 and insertion means 43 complete the packaging phase of the contained articles 3 by inserting the packaging material 40, 41 according to the instructions and commands provided by the logic device 14. As soon as the process of step 150 is completed, in step 155 it is verified whether the packaging process is terminated, and in step 160 the actuated stopping device and the actuated pushing device 9, 10 and 12 are reconfigured (retracted) in order to go back to step 105.

Modifications and/or changes may be made to the apparatus for dispensing and inserting packaging material according to the present invention and method therefor, without departing from the protection domain of the general inventive concept as defined by the appended claims.

The following features, separately or in combination, may also constitute advantageous embodiments of the described or claimed invention:

An apparatus for dispensing and inserting packaging material for packing articles (3) in container (2) comprising: a motorized conveying device (4) for sequentially transporting said containers (2); a detection unit (6) for acquiring geometrical data of the transiting container (2) and the articles (3) contained in said container (2), said detection unit (6) placed along said conveying device (4); a dispensing device (42) that dispenses packaging material and that is placed downstream of said detection unit (6); processing means (14) in communication with said detection unit (6), said processing means being able to generate control signals for said dispensing device (42) of packaging material in the transiting container, wherein said processing means (14) are able to process data coming from said detection unit (6) in order to define and interpret the geometric distribution of the space in the container (2) not occupied by said articles (3), and said dispensing device (42) is able to automatically dispense said packaging material according to said geometric distribution, and that insertion means (43) are foreseen in order to control, on the basis of instructions and commands received from said processing means (14), the placement of the packaging material in said container (2), according to said geometric distribution.

A method for dispensing and inserting packaging material of articles (3) into containers (2), characterized in that it comprises the following steps: automatic detection and processing of the geometry of a container (2) and contained articles (3), and automatic interpretation of the geometric distribution of the space not occupied by said articles (3) in said container (2); conveyance of said container (2) and contained articles (3) to a packaging area (7); and dispensing and insertion of packaging material in said container (2) according to the processing and interpretation of the geometric distribution of the space not occupied by said articles (3) in said container (2).

The invention claimed is:

1. A method for dispensing and inserting packaging material into a container comprising the following steps:

automatically acquiring data characterizing a void space not occupied by articles in the container, determining and interpreting a three-dimensional geometric distribution of the void space on the basis of the acquired data;

defining an amount, size, and shape of packaging material that is to be placed in a defined location within the container based on the interpretation and that corresponds to the three-dimensional geometric distribution of the void space;

automatically dispensing the defined amount, size, and shape of packaging material according to the determined and interpreted geometric distribution of the void space; and controlling placement of the defined amount, size, and shape of packaging material into the container such that a three-dimensional geometric distribution of the packaging material matches up with the three-dimensional geometric distribution of the void space in order to place the defined amount, size, and shape of packaging material in the defined location within the container.

2. A method according to claim 1, wherein the automatic step of determination and interpretation of the geometric distribution of the void space not occupied by the articles in the container comprises locating one or more regions of space that are partially delimited by geometric elements belonging to, or derived from, the geometry of the articles, the geometric elements having characteristics in common or analogous.

3. A method according to claim 2, wherein the characteristics in common or analogous include a distance that the geometric elements, belonging to, or derived from, the geometry of the articles, have from a reference plane.

4. A method according to claim 2 or 3, wherein the interpretation step comprises operations of "association" or "union" of the located regions of void space not occupied by the articles, according to fixed rules and in the modalities allowed by a dispensing device and insertion means, and eventually suggested by a database offering several different possible combinations limited to a simplified classification.

5. A method according to claim 1, wherein the step of dispensing and insertion of packaging material comprises the automatic generation performed by a processing means of instructions and commands about the dispensing and insertion of the packaging material into the container, on a basis of the interpretation of the geometric distribution of the space not occupied by the articles in the container, and the automatic communication of the dispensing and insertion instructions and commands to the corresponding dispensing devices and insertion means.

6. A method according to claim 5, wherein the processing means are adapted to provide results regardless how the containers are oriented during data acquisition.

7. A method according to claim 1, wherein the dispensing and insertion step comprises automatic fabrication of bags filled with a mixture or substance expanding to a foam and the automatic insertion of the bags in the container by means of a manipulator.

8. A method according to claim 1, wherein the dispensing and insertion step comprises conveyance of packaging material into the container without automatic manipulation.

9. A method according to claim 1, wherein the dispensing and insertion step comprises dispensing of loose fill packaging material, comprising chips, by a dispenser and the automatic insertion of the loose fill packaging material by means of a positioning device of the insertion device.

10. A method according to claim 1, wherein the dispensing and insertion step comprises the insertion of packaging material by an operator, according to instructions output by a logic device on a graphic interface.

11. A method for dispensing and inserting packaging material into a container, comprising the following steps:

automatically acquiring data characterizing a void space not occupied by articles in the container, determining and interpreting a three-dimensional geometric distribution of the void space on the basis of the acquired data;

defining an amount, size, and shape of packaging material that is to be placed in a defined location within the container based on the interpretation and that corresponds to the three-dimensional geometric distribution of the void space;

automatically dispensing the defined amount, size, and shape of packaging material according to the determined and interpreted geometric distribution of the void space; and automatically controlling placement of the defined amount, size, and shape of packaging material into the container such that a three-dimensional geometric distribution of the packaging material matches up with the three-dimensional geometric distribution of the void space in order to place the defined amount, size, and shape of packaging material in the defined location within the container, wherein the packaging material is at least one foam-in-place bag.

12. The method of claim 11 wherein the packaging material is a plurality of foam-in-place bags.

13. The method of claim 12 wherein each foam-in-place bag of the plurality of foam-in-place bags is placed in a different defined location within the container.

14. The method of claim 11 wherein the defining step further comprises defining quantities of bags to produce, defining lengths of bags to produce, defining shapes of bags to produce, and defining locations within the container at which to place the bags produced, and wherein the placement step further comprises placing the bags produced in the defined locations within the container and in defined orientations.

* * * * *